US009121174B1

(12) United States Patent
Chen

(10) Patent No.: US 9,121,174 B1
(45) Date of Patent: Sep. 1, 2015

(54) FOLDABLE SOUND ATTENUATOR

(71) Applicant: HWA-YI VENTILATION CO., LTD., New Taipei (TW)

(72) Inventor: Hsin-Chang Chen, New Taipei (TW)

(73) Assignee: HWA-YI VENTILATION CO., LTD., New Taipei (TW)

( * ) Notice: Subject to any disclaimer, the term of this patent is extended or adjusted under 35 U.S.C. 154(b) by 0 days.

(21) Appl. No.: 14/285,919

(22) Filed: May 23, 2014

(51) Int. Cl.

| | |
|---|---|
| ***E04F 17/04*** | (2006.01) |
| ***E04B 1/344*** | (2006.01) |
| ***F24F 13/24*** | (2006.01) |
| ***E04B 1/82*** | (2006.01) |
| *E04F 17/00* | (2006.01) |
| *E04B 1/343* | (2006.01) |
| *F24F 13/00* | (2006.01) |

(52) U.S. Cl.
CPC ..... *E04B 1/8209* (2013.01)

(58) Field of Classification Search
USPC ..... 181/287, 224, 225, 284, 295; 454/346, 454/347, 352, 262, 206, 906
See application file for complete search history.

(56) References Cited

U.S. PATENT DOCUMENTS

| | | | | | |
|---|---|---|---|---|---|
| 2,917,128 | A | * | 12/1959 | Tatay | 181/224 |
| 3,527,339 | A | * | 9/1970 | Cipolla | 206/290 |
| 3,592,289 | A | * | 7/1971 | Aysta et al. | 160/135 |
| 3,778,100 | A | * | 12/1973 | Dillard | 296/164 |
| 4,024,717 | A | * | 5/1977 | Hudson et al. | 405/104 |
| 4,421,203 | A | * | 12/1983 | Bergamini | 181/284 |
| 5,003,924 | A | * | 4/1991 | Dambre | 119/325 |
| 5,260,523 | A | * | 11/1993 | Pettersson et al. | 181/224 |
| 5,268,541 | A | * | 12/1993 | Pettersson | 181/224 |
| 5,679,931 | A | * | 10/1997 | Furse et al. | 181/224 |
| 5,728,980 | A | * | 3/1998 | Zarnick | 181/224 |
| 5,904,262 | A | * | 5/1999 | Coppi | 220/7 |
| 7,021,242 | B2 | * | 4/2006 | Axelrod | 119/496 |
| 7,258,196 | B2 | * | 8/2007 | Radatus et al. | 181/224 |
| 7,475,514 | B2 | * | 1/2009 | Rulquin et al. | 52/79.5 |
| 7,562,743 | B2 | * | 7/2009 | Beeson et al. | 181/287 |
| 8,272,475 | B2 | * | 9/2012 | Helenius et al. | 181/224 |
| 8,695,755 | B2 | * | 4/2014 | Mihaly | 181/287 |
| 2003/0072459 | A1 | * | 4/2003 | Cole et al. | 381/71.7 |
| 2006/0185931 | A1 | * | 8/2006 | Kawar | 181/202 |
| 2013/0001011 | A1 | * | 1/2013 | Panosh | 181/287 |

FOREIGN PATENT DOCUMENTS

| | | | | | |
|---|---|---|---|---|---|
| DE | 3608804 | A1 | * | 9/1987 | G10K 11/16 |
| DE | 10026355 | A1 | * | 1/2002 | F02M 35/12 |
| EP | 2535657 | A1 | * | 12/2012 | |
| GB | 1493052 | A | * | 11/1977 | |
| JP | 08044369 | A | * | 2/1996 | G10K 11/16 |

* cited by examiner

*Primary Examiner* — Edgardo San Martin
(74) *Attorney, Agent, or Firm* — Guice Patents PLLC

(57) ABSTRACT

The present invention relates to a foldable sound attenuator, which includes: a case, formed with a left wall, a right wall, a top wall and a bottom wall, and each of the walls is connected to each other through at least a hinge, the top wall and the bottom wall are divided into at least two sheets, and each of the sheets is connected to each other through at least a hinge; a first sound absorbing plate; a folding plate, one side thereof is connected to the first sound absorbing plate through at least a hinge; and a second sound absorbing plate, connected to another side of the first sound absorbing plate through at least a hinge; wherein the first sound absorbing plate and the second sound absorbing plate are able to be folded and stored in the case through the folding plate and the hinge.

8 Claims, 9 Drawing Sheets

FOLDABLE SOUND ATTENUATOR

BACKGROUND OF THE INVENTION

1. Field of the Invention

The present invention relates to a foldable sound attenuator, especially to a sound attenuator allowing a plurality of sound absorbing plates to be folded and stored in a case by utilizing at least a folding plate and at least a hinge so as to reduce the volume.

2. Description of Related Art

For the equipment in a machine room, when noise and heat are generated, an operation of ventilating and heat dissipating has to be processed, so at least an open hole is require to be formed on a wall of the machine room; as such, a sound attenuator (or sound attenuating equipment) has to be installed in the open hole for reducing the outgoing sound. When the sound attenuator (or the sound attenuating equipment) is installed, because the occupied space is rather large, when the required amount of heat to be dissipated is a lot, the dimension of the open hole has to be correspondingly enlarged, and this often result in there may not be enough space for forming the open hole and installing the sound attenuator, thereby causing the whole heat dissipating and soundproof effect to be poor.

In addition, when an iron rolling door installed in the machine room is closed, the performance of reducing noise volume is not as sufficient as the cement wall (the iron rolling door can reduce about 10~15 dB of noise, and the cement wall can reduce about 50 dB of noise), so noise would be transferred out to the exterior through the iron rolling door and an effective sound attenuating effect cannot be provided.

Moreover, when the amount of open holes in the interior is not enough, the iron rolling door would be opened for being served as a ventilation hole, thus noise would be transferred out to the exterior without being attenuated at all.

Referring to FIG. 1*a* and FIG. 1*b*, wherein FIG. 1*a* is a schematic view illustrating a conventional sound attenuator; and FIG. 1*b* is another schematic view illustrating the conventional sound attenuator. As shown in figures, a conventional sound attenuator 100 includes a case 110 and a plurality of sound attenuating plates 120. The plural sound attenuating plates 120 are respectively disposed in the case 110, and two sides of each of the sound attenuating plates 120 are respectively formed with a plurality of punch holes 121, the interior of the sound attenuating plate 120 is filled with a sound absorbing material (not shown in figures), the sound absorbing material is e.g. but not limited to sound absorbing cottons for achieving a sound attenuating effect.

Referring to FIG. 2, which is a schematic view illustrating the installation of a conventional sound attenuator. As shown in FIG. 2, the above-mentioned conventional sound attenuator often requires an air inlet 130 and an air outlet 140 to be formed on the wall of the machine room for the purpose of ventilation, the area of the air inlet 130 and that of the air outlet 140 are determined by the required ventilating level, and because noise would be transferred out to the exterior through the air inlet 130 and the air outlet 140, the sound attenuator 100 is required to be respectively installed therein for preventing the outgoing noise; however, the installed sound attenuator 100 is heavy and large, so only a fastening means can be adopted for the installation and a large space is therefore occupied.

In view of the above-mentioned disadvantages, the present invention provides a foldable sound attenuator for improvements.

SUMMARY OF THE INVENTION

One primary objective of the present invention is to provide a foldable sound attenuator, which is installed with a folding plate, two sides of the folding plate can be respectively connected to a first sound absorbing plate and a second sound absorbing plate through a hinge thereby enabling the first sound absorbing plate and the second sound absorbing plate to be folded and stored in a case through the folding plate and the hinge.

Another objective of the present invention is to provide a foldable sound attenuator, which has an advantage of greatly reducing the volume after being folded without compromising the anticipated sound attenuating effect.

One another objective of the present invention is to provide a foldable sound attenuator, which has advantages of sufficiently planning the occupied space and solving the poor soundproof problem existed in the iron rolling door of a conventional machine room.

For achieving aforesaid objectives, the present invention provides a foldable sound attenuator, which includes: a case, formed with a left wall, a right wall, a top wall and a bottom wall, an accommodation space is formed by the four walls, and each of the walls is connected to each other through at least a hinge, the top wall and the bottom wall are divided into at least two sheets, and each of the sheets is connected to each other through at least a hinge; a first sound absorbing plate, disposed in the accommodation space; a folding plate, disposed at one side of the first sound absorbing plate, and one side thereof is connected to the first sound absorbing plate through at least a hinge; and a second sound absorbing plate, disposed in the accommodation space and at another side of the folding plate, and connected to another side of the first sound absorbing plate through at least a hinge; wherein the first sound absorbing plate and the second sound absorbing plate are able to be folded and stored in the case through the folding plate and the hinge.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
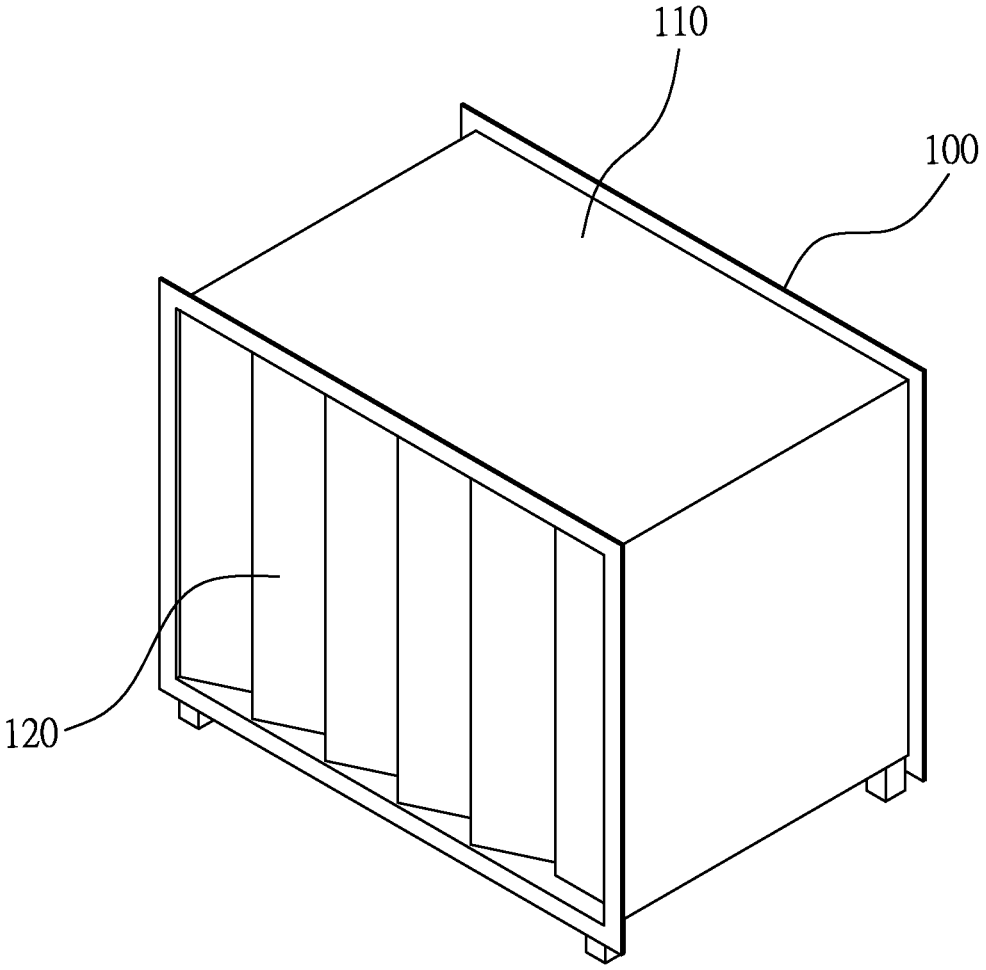
(PRIOR ART) FIG. 1a
FIG. 1*a* is a schematic view illustrating a conventional sound attenuator.
Figure 1B:
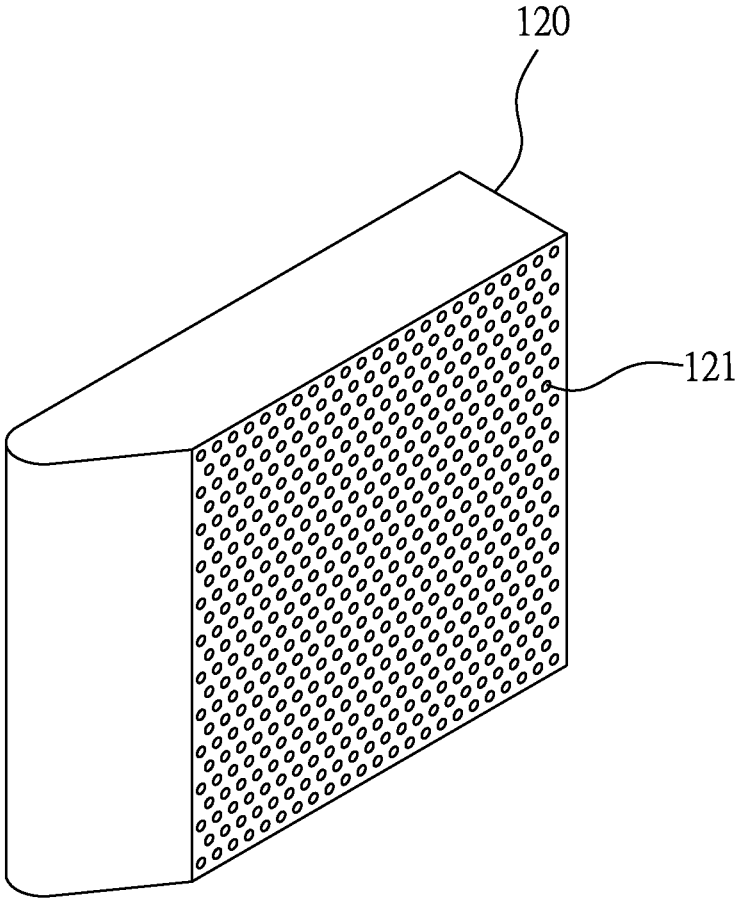
(PRIOR ART) FIG. 1b
FIG. 1*b* is another schematic view illustrating the conventional sound attenuator.
Figure 2:
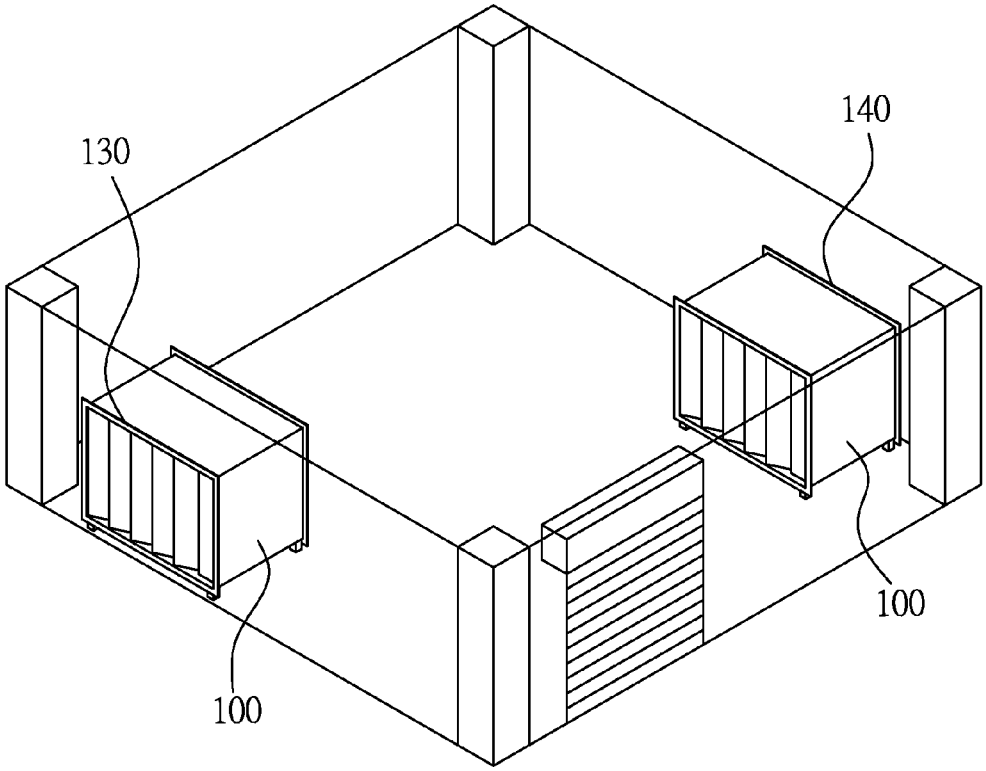
(PRIOR ART) FIG. 2
FIG. 2 is a schematic view illustrating the installation of a conventional sound attenuator.
Figure 3:
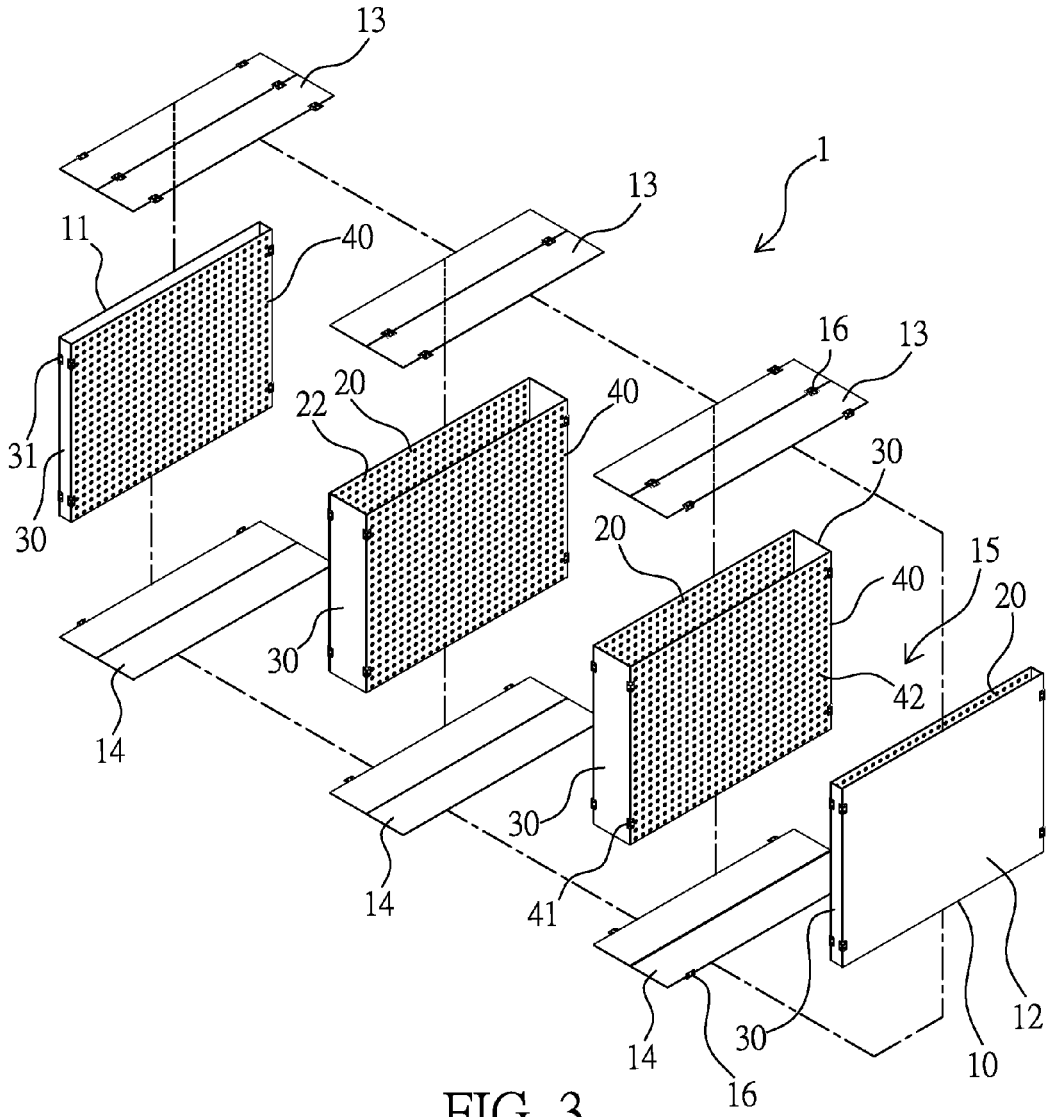
FIG. 3 is an exploded view illustrating the foldable sound attenuator according to one preferred embodiment of the present invention.
Figure 4:
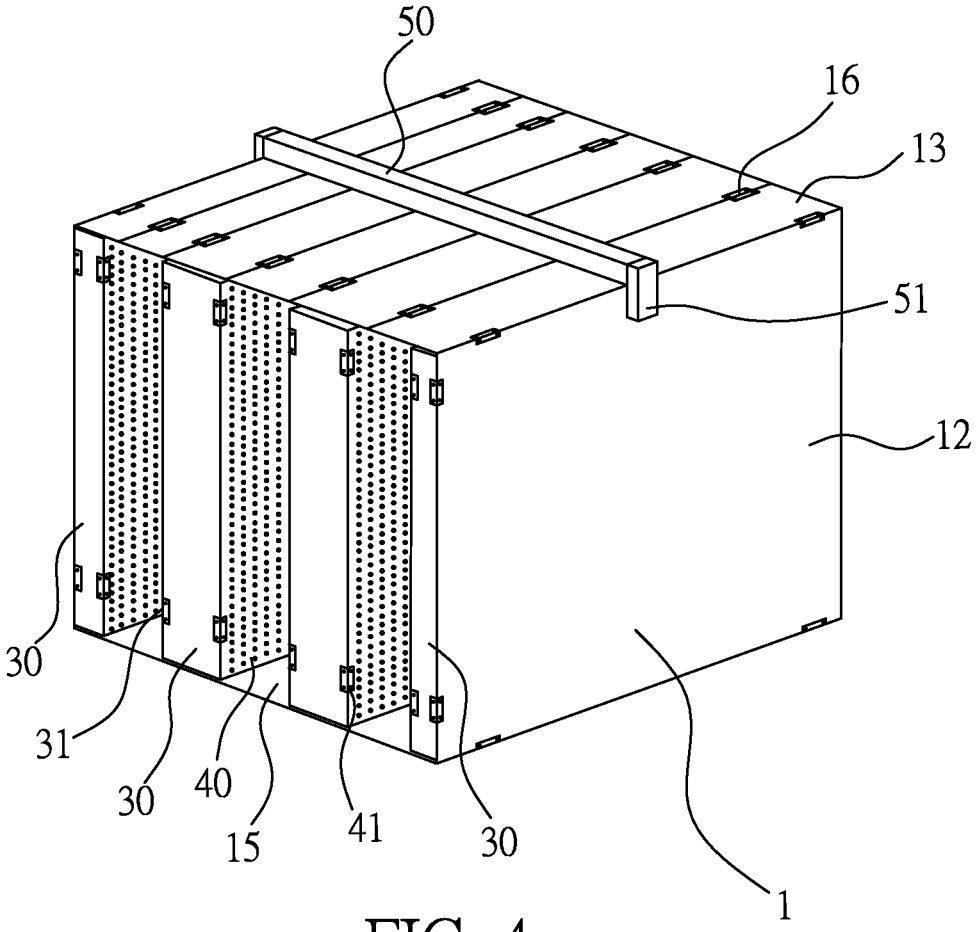
FIG. 4 is a schematic view illustrating the assembly of the foldable sound attenuator according to one preferred embodiment of the present invention.

Referring to FIG. 3 and FIG. 4, wherein FIG. 3 is an exploded view illustrating the foldable sound attenuator according to one preferred embodiment of the present invention; and FIG. 4 is a schematic view illustrating the assembly of the foldable sound attenuator according to one preferred embodiment of the present invention.

As shown in figures, the present invention provides a foldable sound attenuator 1, which includes: a case 10, a first sound absorbing plate 20, a folding plate 30 and a second sound absorbing plate 40.

The case 10 is e.g. but not limited to be made of a metal material, and formed with a left wall 11, a right wall 12, a top wall 13 and a bottom wall 14, an accommodation space 15 is defined by the four walls 11, 12, 13, 14, and each of the walls 11, 12, 13, 14 is connected to each other through at least a hinge 16. The top wall 13 and the bottom wall 14 are divided into at least two sheets, and each of the sheets is connected to each other through at least a hinge 16. Wherein, the left wall 11, the right wall 12, the top wall 13 and the bottom wall 14 are e.g. but not limited to a steel plate. According to this embodiment, the top wall 13 and the bottom wall 14 are respectively divided into six sheets, and each of the sheets is connected to each other through two hinges 16, the above-mentioned arrangement is served for illustration and shall not be a limitation to the scope of the present invention.

The first sound absorbing plate 20 is disposed in the accommodation space 15, and preferably fastened in the accommodation space 15. Wherein, the first sound absorbing plate 20 is e.g. but not limited to a micro-hole sound absorbing plate, and formed with a plurality of micro holes 22, the micro holes 22 are able to guide an airflow into the first sound absorbing plate 20 thereby achieving a sound attenuating effect. According to this embodiment, three first sound absorbing plates 20 are adopted for illustration and shall not be a limitation to the scope of the present invention.

The folding plate 30 is disposed at one side of the first sound absorbing plate 20, e.g. but not limited to the left side, and one side thereof, e.g. but not limited to the right side, is connected to the first sound absorbing plate 20 through at least a hinge 31. Wherein, the folding plate 30 is e.g. but not limited to a steel plate. According to this embodiment, four folding plates 30 are adopted for illustration and shall not be a limitation to the scope of the present invention.

The second sound absorbing plate 40 is disposed in the accommodation space 15 and arranged at another of the folding plate 30, e.g. but not limited to the left side, and the second sound absorbing plate 40 is connected to another side of the first sound absorbing plate 20 through at least a hinge 41. Wherein, the second sound absorbing plate 40 is e.g. but not limited to a micro-hole sound absorbing plate, and formed with a plurality of micro holes 42, the micro holes 42 are able to guide an airflow into the second sound absorbing plate 40 thereby achieving the sound attenuating effect. According to this embodiment, three second sound absorbing plates 40 are adopted for illustration and shall not be a limitation to the scope of the present invention.

In addition, the foldable sound attenuator 1 provided by the present invention further includes a buckle plate 50 disposed on the case 10 and two ends thereof are buckled on the top wall 13, the left wall 11 and the right wall 12 through a buckle member 51 thereby enabling the case 10, the first sound absorbing plates 20 and the second sound absorbing plates 40 to be secured.

When the foldable sound attenuator 1 is assembled, the three first sound absorbing plates 20 are respectively disposed in the accommodation space 15 and fastened in the accommodation space 15; the three second sound absorbing plates 40 are respectively disposed in the accommodation space 15, and the three first sound absorbing plates 20 and the three second sound absorbing plates 40 are arranged in pairs; lastly the four folding plates 30 are respectively disposed between the first sound absorbing plates 20 and the second sound absorbing plates 40, and each of the first sound absorbing plates 20 is connected to each of the corresponding second sound absorbing plates 40 through at least a hinge 31; accordingly, the foldable sound attenuator provided by the present invention is assembled. According to this embodiment, the arrangement of adopting four folding plates 30, three first sound absorbing plates 20 and three second sound absorbing plates 40 is served for illustration and shall not be a limitation to the scope of the present invention, the quantity of the folding plate 30, the first sound absorbing plate 20 and the second sound absorbing plate 40 can be increased or decreased with respect to the actual noise volume.

Figure 5A:
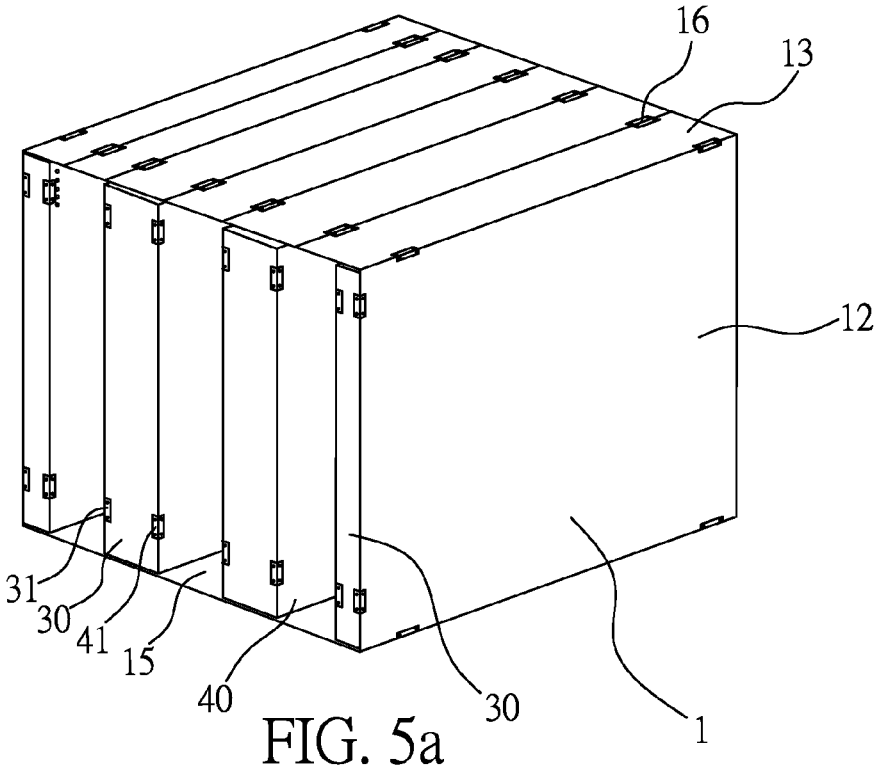
FIG. 5*a* is a schematic view illustrating the foldable sound attenuator being fully unfolded according to one preferred embodiment of the present invention.
Figure 5B:
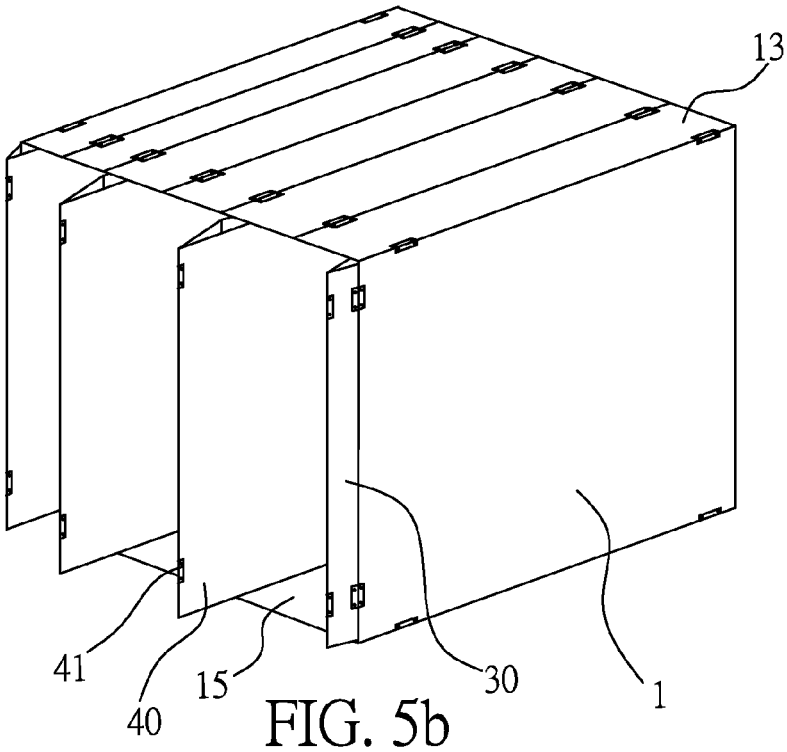
FIG. 5*b* is a schematic view illustrating the folding plates being folded and flattened while the foldable sound attenuator being folded according to one preferred embodiment of the present invention.
Figure 5C:
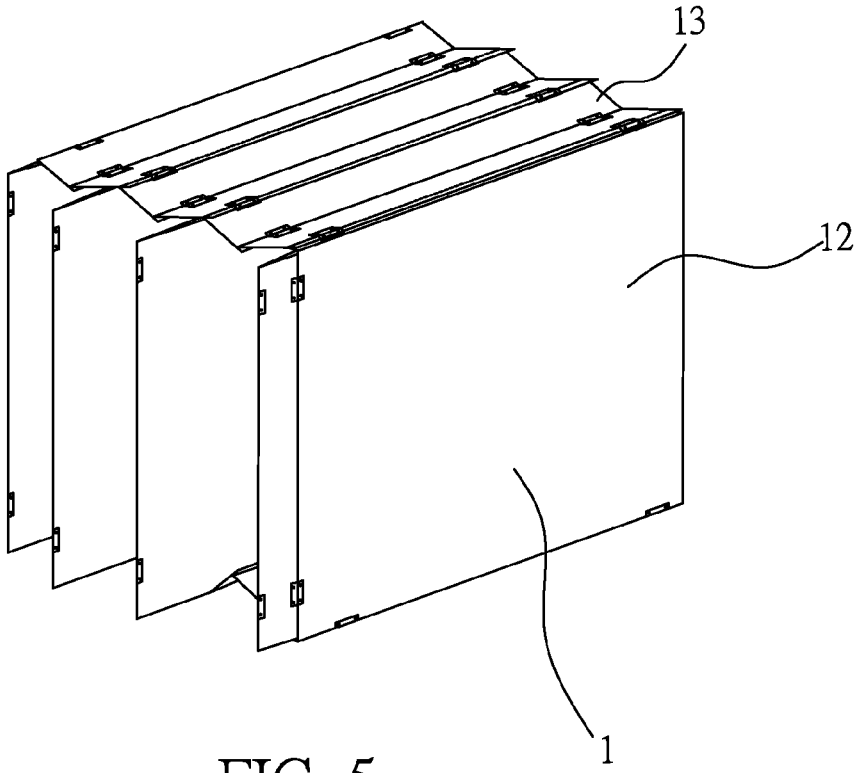
FIG. 5*c* is a schematic view illustrating the top walls being bent while the foldable sound attenuator being folded according to one preferred embodiment of the present invention.
Figure 5D:
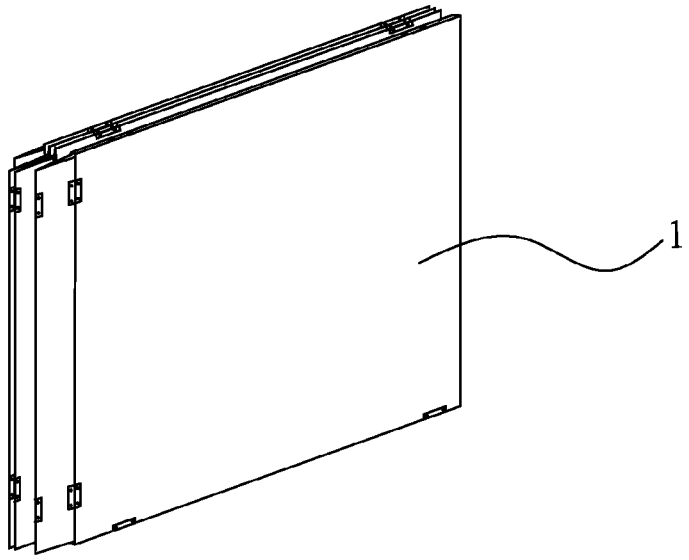
FIG. 5*d* is a schematic view illustrating the foldable sound attenuator being fully folded according to one preferred embodiment of the present invention.

Referring from FIG. 5*a* to FIG. 5*d*, wherein FIG. 5*a* is a schematic view illustrating the foldable sound attenuator being fully unfolded according to one preferred embodiment of the present invention; FIG. 5*b* is a schematic view illustrating the folding plates being folded and flattened while the foldable sound attenuator being folded according to one preferred embodiment of the present invention; FIG. 5*c* is a schematic view illustrating the top walls being bent while the foldable sound attenuator being folded according to one preferred embodiment of the present invention; and FIG. 5*d* is a schematic view illustrating the foldable sound attenuator being fully folded according to one preferred embodiment of the present invention. As shown in FIG. 5*b*, when being in a folded status, the four folding plates 30 are outwardly pulled for being flattened, so the second sound absorbing plates 40 are able to be moved for being adjacent to the first sound absorbing plates 20; as shown in FIG. 5*c*, the six top walls 13 and the six bottom walls 14 are arranged in pairs thereby allowing to be downwardly bent through the hinges 16; as shown in FIG. 5*d*, the left wall 11 and the right wall 12 are pressed towards the central thereby enabling the four folding plates 30, the three first sound absorbing plates 20 and the three second sound absorbing plates 40 to be flattened and folded between the left wall 11 and the right wall 12. As such, the foldable sound attenuator 1 provided by the present invention utilizes the installation of the folding plates 30 and the hinges 31 to enable the first sound absorbing plates 20 and the second sound absorbing plates 40 to be folded and stored in the case 10, thereby achieving an objective of reducing the volume without compromising the anticipated sound attenuating effect. Accordingly, the foldable sound attenuator provided by the present invention is novel and more practical in use comparing to the conventional sound attenuator.

Figure 6A:
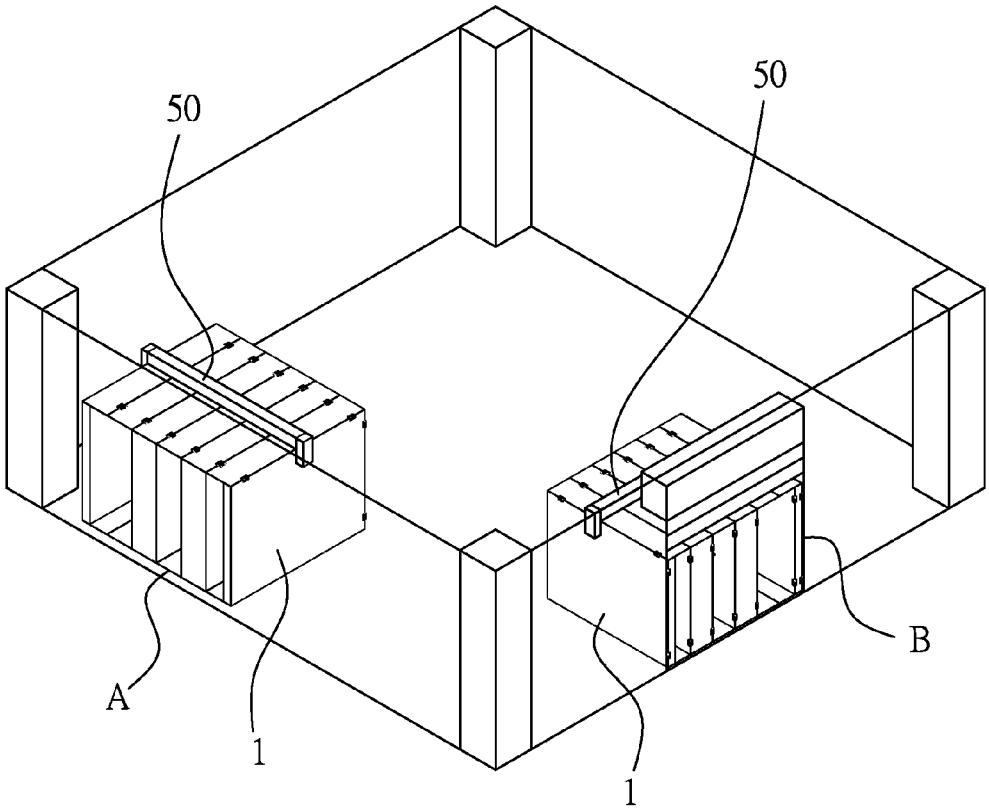
FIG. 6*a* is a schematic view illustrating the foldable sound attenuator being unfolded and installed in a factory.
Figure 6B:
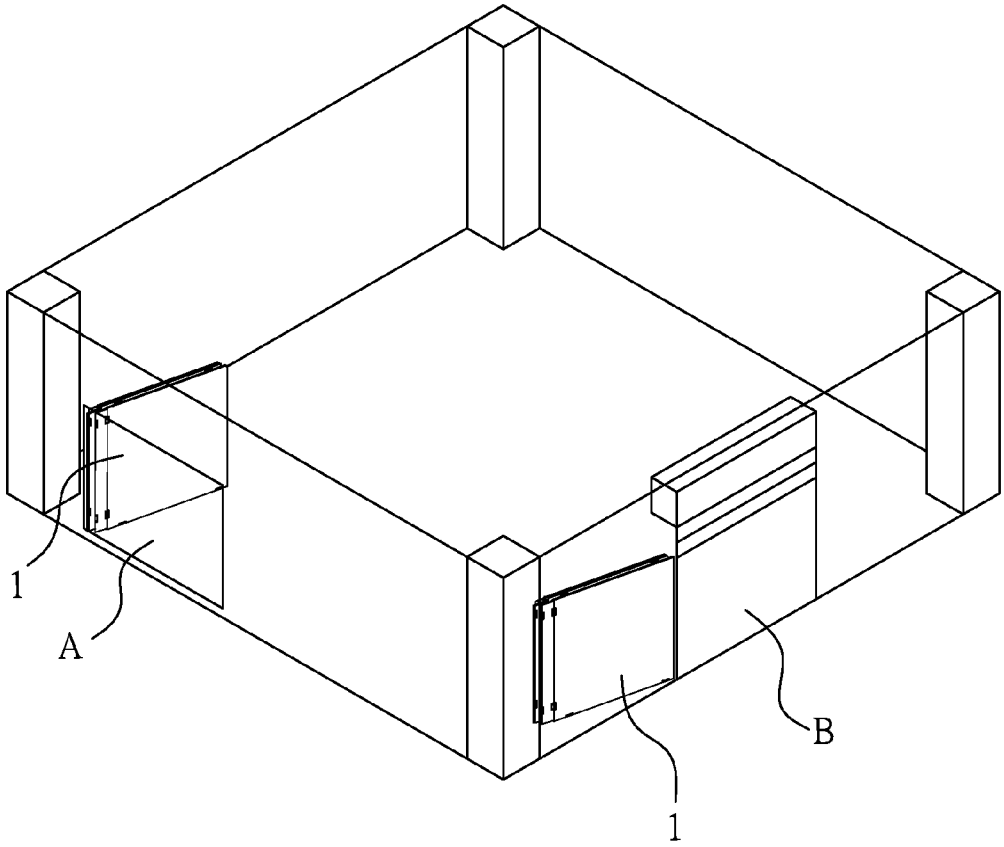
FIG. 6*b* is a schematic view illustrating the foldable sound attenuator being folded and installed in a factory.

Referring to FIG. 6*a* and FIG. 6*b*, wherein FIG. 6*a* is a schematic view illustrating the foldable sound attenuator being unfolded and installed in a factory; and FIG. 6*b* is a schematic view illustrating the foldable sound attenuator being folded and installed in a factory. As shown in FIG. 6*a*, two foldable sound attenuators 1 of the present invention are respectively unfolded and installed at an air inlet A and an iron rolling door B of a factory; when in use, the iron rolling door B can be opened for allowing the airflow to be introduced into the factory through the air inlet A and discharged out of the factory through the iron rolling door B, the above-mentioned airflow flowing path would pass the two foldable sound attenuators 1 provided by the present invention, so the airflow is able to be silenced by the first sound absorbing plates 20 and the second sound absorbing plates 40 thereby greatly reducing the outgoing noise.

As shown in FIG. 6*b*, when not in use, the two foldable sound attenuators 1 can be folded with the means disclosed from FIG. 5*a* to FIG. 5*d*, and respectively disposed at one side of the air inlet A and the iron rolling door B; as such, the air inlet A can be kept for allowing smooth air flowing, and the operation of the iron rolling door B would not be affected. Accordingly, after the foldable sound attenuator 1 provided by the present invention is folded, the volume can be greatly reduced without compromising the anticipated sound attenuating effect; and the present invention is also provided with advantages of sufficiently planning the occupied space and solving the poor soundproof problem existed in the iron rolling door of a conventional machine room.

Based on what has been disclosed above, the foldable sound attenuator provided by the present invention is installed with a folding plate, two sides of the folding plate can be respectively connected to a first sound absorbing plate and a second sound absorbing plate through a hinge thereby enabling the first sound absorbing plate and the second sound absorbing plate to be folded in the case through the folding plate and the hinge; the folding process allows the volume to be greatly reduced without compromising the anticipated sound attenuating effect; and the present invention is also provided with advantages of sufficiently planning the occupied space and solving the poor soundproof problem existed in the iron rolling door of a conventional machine room. Accordingly, the foldable sound attenuator provided by the present invention is novel and more practical in use comparing to the conventional sound attenuator.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A foldable sound attenuator, including:

a case, formed with a left wall, a right wall, a top wall and a bottom wall, wherein an accommodation space being formed by said four walls, and each of said walls being connected to each other through at least a hinge, said top wall and said bottom wall being divided into at least two sheets, and each of said sheets being connected to each other through at least a hinge;

a first sound absorbing plate, disposed in the accommodation space;

a folding plate, disposed at one side of said first sound absorbing plate, and one side thereof being connected to said first sound absorbing plate through at least a hinge; and a second sound absorbing plate, disposed in said accommodation space and at another side of said folding plate, and connected to another side of said first sound absorbing plate through at least a hinge;

wherein said first sound absorbing plate and said second sound absorbing plate being enabled to be folded and stored in said case through said folding plate and said hinge.

2. The foldable sound attenuator as claimed in claim 1, wherein said case is made of a metal material, and said left wall, said right wall, said top wall and said bottom wall are respectively a steel plate.

3. The foldable sound attenuator as claimed in claim 1, wherein said first sound absorbing plate is a micro-hole sound absorbing plate, and formed with a plurality of micro holes, said micro holes are able to guide an airflow into said first sound absorbing plate thereby achieving a sound attenuating effect.

4. The foldable sound attenuator as claimed in claim 1, wherein said second sound absorbing plate is a micro-hole sound absorbing plate, and formed with a plurality of micro holes, said micro holes are able to guide an airflow into said second sound absorbing plate thereby achieving a sound attenuating effect.

5. The foldable sound attenuator as claimed in claim 1, wherein said folding plate is a steel plate.

6. The foldable sound attenuator as claimed in claim 1, further including a buckle plate disposed on said case, and two ends thereof are buckled on said top wall, said left wall and said right wall through a buckle member thereby enabling said case, said first sound absorbing plate and said second sound absorbing plate to be secured.

7. The foldable sound attenuator as claimed in claim 1, wherein said folding plate is disposed at the left side of said first sound absorbing plate, and the right side thereof is connected to said first sound absorbing plate through at least a hinge.

8. The foldable sound attenuator as claimed in claim 1, wherein said second sound absorbing plate is disposed at the left side of said folding plate, and the front side thereof is connected to the left side of said first sound absorbing plate through at least a hinge.

* * * * *